US007503949B2

(12) United States Patent
Larson

(10) Patent No.: US 7,503,949 B2
(45) Date of Patent: Mar. 17, 2009

(54) ABRASIVE ARTICLE AND METHOD

(75) Inventor: Eric G. Larson, Lake Elmo, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 307 days.

(21) Appl. No.: 11/218,808

(22) Filed: Sep. 1, 2005

(65) Prior Publication Data

US 2007/0044384 A1 Mar. 1, 2007

(51) Int. Cl.

| | |
|---|---|
| ***C09K 3/14*** | (2006.01) |
| *B05D 7/14* | (2006.01) |
| *B32B 5/24* | (2006.01) |
| *D21H 17/29* | (2006.01) |
| *D21H 19/62* | (2006.01) |

(52) U.S. Cl. ..... 51/298; 106/287.22; 442/156

(58) Field of Classification Search ..... 51/298; 106/287.22; 442/156

See application file for complete search history.

(56) References Cited

U.S. PATENT DOCUMENTS

| | | | | |
|---|---|---|---|---|
| 4,224,422 | A | 9/1980 | Rude et al. | |
| 4,396,657 | A * | 8/1983 | Ibrahim | 428/36.3 |
| 4,609,380 | A | 9/1986 | Barnett et al. | |
| 4,751,138 | A * | 6/1988 | Tumey et al. | 428/323 |
| 5,152,917 | A | 10/1992 | Pieper et al. | |
| 5,271,964 | A * | 12/1993 | Ohishi | 427/386 |
| 5,290,903 | A | 3/1994 | Hsu et al. | |
| 5,391,210 | A | 2/1995 | Bilkadi et al. | |
| 5,639,546 | A | 6/1997 | Bilkadi | |
| 5,840,822 | A | 11/1998 | Lee et al. | |
| 6,140,388 | A | 10/2000 | Nass et al. | |
| 6,551,366 | B1 | 4/2003 | D'Souza et al. | |
| 7,049,354 | B2 * | 5/2006 | Yamoto et al. | 523/415 |

FOREIGN PATENT DOCUMENTS

| | | |
|---|---|---|
| EP | 0 573 775 A1 | 12/1993 |
| EP | 0 598 312 A2 | 5/1994 |

OTHER PUBLICATIONS

Dr. F. Parodi, "Fast-Curing Isocyanate-Epoxy Resin Systems for Structural and Heavy-Duty Applications" Technical Brochure.

* cited by examiner

*Primary Examiner*—Jerry Lorengo
*Assistant Examiner*—Matthew E Hoban
(74) *Attorney, Agent, or Firm*—Dean M. Harts; Stephen F. Wolf

(57) ABSTRACT

Provided are abrasive articles comprising a plurality of abrasive particles and a binder wherein the binder comprises a polymer formed by a reaction between a polyisocyanate and a polyoxirane, wherein the resulting binder is substantially free of urethane and urea linkages. Also provided is a method of making such an abrasive article.

20 Claims, No Drawings

ABRASIVE ARTICLE AND METHOD

FIELD OF THE INVENTION

The invention relates to an abrasive article and a method of making an abrasive article, more particularly to a binder suitable for forming abrasive articles.

BACKGROUND OF THE INVENTION

Some forms of abrasive articles comprise a plurality of abrasive particles and a binder. Many different types of abrasive articles are available. Among these are: (1) coated abrasive articles, in which a binder make coat bonds the abrasive particles to a backing material (e.g., "sandpaper"); (2) lapping coated abrasive articles, in which the abrasive particles are dispersed in a binder to form an abrasive composite, which is bonded to a backing to form an abrasive article; (3) three-dimensional shaped composite abrasive articles, in which the abrasive particles are dispersed in a binder to form a plurality of abrasive composites, which are bonded to a backing to form an abrasive article; (4) bonded abrasive articles, in which the binder bonds the particles together to form a shaped mass, e.g., a grinding wheel or brush; and (5) nonwoven abrasive articles, in which the binder bonds the abrasive particles onto the fibers of a nonwoven fibrous substrate in either a make coat or dispersed format. The binder in the abrasive article is usually formed by curing a binder precursor. During the preparation of the abrasive article, the binder precursor is exposed to an energy source, which typically results in the polymerization or crosslinking of the polymer or resin to form a solid binder. The energy source can provide thermal energy, or radiation energy, e.g., electron beam, ultraviolet light, or visible light.

SUMMARY OF THE INVENTION

Briefly, the invention provides an abrasive article comprising a plurality of abrasive particles and a binder wherein the binder comprises a polymer formed by a reaction between a polyisocyanate and a polyoxirane wherein the resulting binder is substantially free of urethane and urea linkages. The binder is formed as the reaction product of a polyisocyanate and a polyoxirane under conditions in which the principal groups connecting hydrocarbon segments along the polymer backbone are oxazolidone groups.

In some embodiments, a second binder component may also be present provided that said second binder component is also substantially free of urethane and urea linkages. In another embodiment, the invention provides an abrasive article comprising a plurality of abrasive particles and a binder wherein the binder comprises a first polymer formed by a reaction between a polyisocyanate and a polyoxirane and a second polymer formed by a second polymerization reaction wherein the resulting binder is substantially free of urethane and urea linkages.

In still other embodiments, the invention provides an abrasive article comprising a plurality of abrasive particles and a binder. In this aspect, the binder may comprise a first polymer that is the reaction product of a polyisocyanate and a polyoxirane, which can be carried out under conditions in which the principal groups connecting hydrocarbon segments are oxazolidone groups, and a second binder component, also substantially free of urethane and urea linkages, wherein the first and second binder components are chemically linked by the reaction products of residual functionality of the two components.

In still another aspect, the invention provides a method of making an abrasive article as described above comprising providing a plurality of abrasive particles, providing a binder comprising a polymer formed by a reaction product of a polyisocyanate and a polyoxirane, wherein the resulting binder is substantially free of urethane and urea linkages, and distributing the abrasive particles and the binder on a backing.

DETAILED DESCRIPTION

The term "substantially free of", as used herein refers to compositions having no more than incidental amounts of the specified functionality, usually found at less than one percent of the possible sites for such functionality. These incidental amounts, when present at measurable levels, may be regarded as impurities.

A variety of binder compositions and polymerization and/or crosslinking reactions leading to binder compositions suitable for use in abrasive articles have been described. Polyurethanes, including acrylated polyurethanes, have been popular binders for abrasive articles despite concerns regarding the susceptibility of the urethane linkage to hydrolysis, particularly at elevated temperatures such as those that may be encountered during abrasive processing. Similar concerns have been raised concerning polymers with urea linkages.

It has been found that the mutual reaction of readily available polyisocyanates and polyoxiranes, under appropriate conditions, leads to the formation of a polymer having oxazolidone ring structures distributed along the backbone. To the extent that the ring may be subject to hydrolysis, the ring-opened product retains a continuous carbon-carbon bond sequence rather than forming the cleavage products typical of urethanes or ureas.

Although abrasive articles having binders which contain oxazolidone groups may be found in the literature, those groups have been formed terminal to polyurethane polymers or have been used as crosslinking sites or crosslinking agents for polyurethanes and/or polyurea binders.

The present invention uses the formation of oxazolidone groups as a principal mechanism for the formation of the polymeric backbone of the binder for the abrasive article and provides a polymeric backbone that is substantially free of urethane or urea linkages between the hydrocarbon segments. Any urethane or urea linkages present are the result of contamination and or impurities. Usually less than about 1% of the groups between hydrocarbon groups are urethane or urea groups. These binders are typically resistant to solvents, water uptake, and thermal degradation. These binders typically provide excellent adhesion to the abrasive grains and to common substrates, if present.

In addition to these properties, it has been found that binders for abrasive articles that are harder often provide improved performance in coated abrasive applications. Binders formed as the reaction product of a polyisocyanate and a polyoxirane wherein the resulting binder is substantially free of urethane and urea linkages are typically harder than alternative binders described as fast cure, zero Volatile Organic Compounds (VOC) materials suitable for use as binders in abrasive constructions.

In some embodiments, the abrasive articles of the invention may comprise any known abrasive particles including individual particles, clustered particles, abrasive agglomerates and combinations thereof. The abrasive particles in most embodiments will be inorganic. Also, organic particulates may be used instead of, or in addition to, more traditional inorganic abrasive particles.

In some embodiments, the abrasive article will comprise a backing. The backing, when used, generally can be in the form of a sheet or a fiber at least partially covered by a binder. In some embodiments, the abrasive particles can be distributed onto at least a portion of the binder. In some embodiments, the abrasive particles can be distributed throughout at least a portion of the binder. In other embodiments, the binder can be applied over the abrasive coating as a size or supersize coating. In some embodiments, the abrasive particles can be distributed throughout the binder. In yet other embodiments, the abrasive particles can be distributed throughout at least a portion of the binder. In another aspect, the binder can form a plurality of three-dimensional textured composites distributed over the abrasive surface. These composites may be formed in place or may be formed in a separate step and distributed onto a binder. In some embodiments, the abrasive article will be in the form of a shaped mass such as a grinding wheel or abrasive brush.

In some embodiments, the abrasive article may include any known additive such as fillers, reinforcing agents, lubricants, cutting aids, plasticizers, and the like.

Although the functionalities of the polyisocyanate and the polyoxirane precursors preferably are two to ensure that the resulting polymeric backbone comprises alternating residues from the respective precursors connected by oxazolidone groups, it may be desirable in selected embodiments to include monofunctional or polyfunctional isocyanate or oxirane moieties to control molecular weight and/or crosslinking. In some embodiments, the polyisocyanate will have, on average, more than two reactive isocyanate groups per molecule. In some embodiments, the polyoxirane will have, on average, more than two reactive oxirane groups per molecule. Precursor functionality greater than two tends to provide crosslinking and may provide residual functionality for reactive coupling with a second binder component.

The abrasive article of the present invention can be made via any known method. More particularly, the invention can be used in a coated abrasive article, a fixed abrasive article, and the like. In one aspect, an abrasive article according to the present invention can be prepared by providing a binder comprising a polymer formed by a reaction product of a polyisocyanate and a polyoxirane, wherein the resulting binder is substantially free of urethane and urea linkages, and distributing a plurality of abrasive particles and the binder on a substrate or backing. Any known abrasive article backing can be used, e.g., cloth, film, foil, paper, fibrous material, polymeric film, and the like.

EXAMPLES

List of Materials

AA07—spherical aluminum oxide particle, 0.7 μm average particle size—(available from Summit Specialty Chemicals, Fort Lee, N.J.)

Additive 7—fluorosilicone air release agent (available from Dow Corning Chemical Corp., Midland, Mich.)

CD1010, triarylsulfonium hexafluoroantimonate (available from Sartomer Corp., Exton, Pa.)

Desmorapid DB—N,N-dimethylbenzyl amine (available from Bayer Corp., Pittsburgh, Pa.)

Desmodur CB 75—aromatic isocyanate prepolymer (TDI (toluene diisocyanate) based) (available from Bayer)

Desmodur IL—aromatic isocyanate trimer (TDI based) (available from Bayer)

Desmodur HL—aromatic/aliphatic isocyanate prepolymer (TDI/HDI (hexamethylene diisocyanate) based) (available from Bayer)

Epalloy 8220—bisphenol F epoxy resin (available from CVC Specialty Chemical Co., Moorestown, N.J.)

Epon 828—epoxy resin (available from Resolution Performance Products LLC, Houston, Tex.)

ERL 4221—cycloaliphatic epoxy—7-oxabicyclo[4.1.0]heptane-3-carboxylic acid, 7-oxabicyclo[4.1.0]hept-3-yl methyl ester (available from Dow Chemical Corp., Midland, Mich.)

Irgacure 651—2,2-dimethoxy-2-phenylacetophenone photoinitiator (available from Ciba Specialty Chemicals Corp., Basel, Switzerland)

Irgacure 819—bis(2,4,6-trimethylbenzoyl)phenyl phosphine oxide photoinitiator (available from Ciba Specialty Chemicals)

Mondur MR—aromatic isocyanate (MDI (methylene bisphenyl isocyanate)=based) prepolymer (available from Bayer)

OX-50—amorphous fumed silica particles (available from DeGussa Corp. Parsippany, N.J.)

P120 brown aluminum oxide (available from Triebacher Schleifmittel Corp., Niagara Falls, N.Y.)

PAPI 27—aromatic isocyanate prepolymer (MDI based) (available from Dow Chemical Corp.)

PAPI 580N—aromatic isocyanate (MDI based) trimer (available from Dow Chemical Corp.)

PWA3—3 micrometer white aluminum oxide (available from Fujimi Corporation, Elmhurst, Ill.)

Silwet L-7604 organosilicone surfactant (available from OSi Specialties, Inc., Sistersville, W. Va.)

Solsperse 24000—polymeric dispersant (available from Avecia Corp., Wilmington, Del.)

Solsperse 32000—polymeric dispersant (available from Avecia)

SP1086—milled glass frit (available from Specialty Glass, Inc. Wilmington, Del.)

SR 368—tris(2-hydroxy ethyl) isocyanurate triacrylate (from Sartomer)

STADEX 230—dextrin (available from A. E. Staley Manufacturing Co., Decatur, Ill.)

TMPTA—trimethylolpropane triacrylate (SR 351 available from Sartomer)

Wollastonite—$CaSiO_3$ available as Nyad 400 (from Nyco Minerals Inc., Willsboro, N.Y.)

In the following examples, micron or μm means micrometer.

General Procedure for Making a Coated Abrasive Article

Coated abrasive articles comprising the agglomerate abrasive grains were prepared generally as described in U.S. Pat. No. 5,152,917 (Pieper et al.), the disclosure of which is herein incorporated by reference. Ingredients in each example in Table 1 were mixed together to provide a slurry. The slurry was coated into a polymeric (polypropylene) mold having cavities with the approximate dimensions: 0.350 mm (height)×1.3 mm (width)×1.3 mm (length). A polyester film backing having a thickness of 0.125 mm was placed over the slurry and a rubber roll was pressed upon the polyester film backing to fill the cavities and remove excess slurry from between the mold and the surface of the polyester film backing. The slurry was partially cured by passing the mold, slurry, and backing combination under two medium pressure mercury bulbs (400 watt/inch, 157.5 watt/cm) available from American Ultra Violet Company, Lebanon, Ind., at about 30 feet/minute (9 meters/minute (m/min.)) for a total of three passes. The partially cured slurry, adhered to the polyester film backing, was removed from the mold. Each sample was then thermally post cured for two hours in an oven set at 125° C.

Lapping Test Procedure

The abrading performance of Example 1-6 coated abrasive articles (30.5 cm circular disks mounted with double sided pressure sensitive adhesive tape (obtained as "442PC" from 3M Company St. Paul, Minn.), was evaluated using a single side lapping machine (obtained as "6Y-1" from R. Howard Strasbaugh, Inc. of Long Beach, Calif.) that had been modified as follows.

For glass testing, the workpiece was a borosilicate glass disc that had an outer diameter of 65 mm. The workpiece holder utilized a spring-loaded acetal resin ring having a 65 mm inner diameter to constrain the glass disc during abrading. A 65 mm diameter carrier pad (obtained under the trade designation "DF2000" from Rodel of Newark, Del.) was mounted on the steel back-up plate of the workpiece holder. The glass disc surface opposite the surface to be abraded was placed against the carrier pad which had been moistened with water. With no force applied, the surface of the acetal resin ring protruded beyond the surface of the glass disc. The workpiece holder was brought into contact with the coated abrasive article so that the acetal resin ring retracted and there was direct contact of the glass disc with the coated abrasive article. Sufficient force was applied so that the resultant pressure on the glass disc was about 281 g/cm$^2$. The glass disc center was initially offset from the coated abrasive article center about 70 mm. The coated abrasive article was rotated at about 150 rotations per minute (rpm) in the clockwise direction as viewed from the top. The workpiece holder was rotated at 50 rpm, also in the clockwise direction. A 10 volume percent (vol %) solution of a synthetic lubricant (available as "Sabrelube 9016" from Chemetall-Oakite, Berkeley Heights, N.J.) in water was dripped directly onto the coated abrasive article at a flow rate of about 50 mL/minute. The disc was oscillated radially over the coated abrasive article a distance of about 25 mm. One period of oscillation was about 15 sec. To precondition the coated abrasive article, a rough glass disc (Ra about 1-2 μm) was abraded on the coated abrasive article for 5 minutes at a pressure of 281 g/cm$^2$. A smooth glass disc, prepared and mounted as above, was inserted in the workpiece holder and was abraded at a pressure of about 281 g/cm$^2$ for five min. Successive smooth glass discs were introduced into the workpiece holder and ground at a pressure of about 281 g/cm$^2$ for 5 min. The test glass discs were weighed before and after each cycle to determine the total removal in grams. Using a glass disc density of 2.4 g/cm and a glass disc area of 33.18 cm$^2$, the mass of material removed was converted to equivalent micrometers per minute (μm/min.).

For testing on silicon wafers, the workpieces were single crystal silicon wafers that had an outer diameter of 100 mm. The workpiece holder utilized a spring loaded acetal resin ring having a 100 mm inner diameter to constrain the silicon wafer during abrading. A 100 mm diameter carrier pad ("DF2000" from Rodel of Newark, Del.) was mounted on the steel back-up plate of the workpiece holder. The silicon wafer surface opposite the surface to be abraded was placed against the carrier pad which had been moistened with water. With no force applied, the surface of the acetal resin ring protruded beyond the surface of the silicon wafer. The workpiece holder was brought into contact with the coated abrasive article so that the acetal resin ring retracted and there was direct contact of the silicon wafer with the coated abrasive article. Sufficient force was applied so that the resultant pressure on the silicon wafer was about 211 g/cm$^2$. The silicon wafer center was initially offset from the coated abrasive article center about 50 mm. The coated abrasive article was rotated at about 150 rpm in the clockwise direction as viewed from the top. The workpiece holder was rotated at 50 rpm, also in the clockwise direction. A 10 vol % solution of a synthetic lubricant ("Sabrelube 9016") in water was dripped directly onto the coated abrasive article at a flow rate of about 50 mL/min. The disc was oscillated radially over the coated abrasive article a distance of about 25 mm. One period of oscillation was about 15 sec. To precondition the coated abrasive article, a rough glass disc (Ra about 1-2 μm) was abraded on the coated abrasive article for 5 minutes at a pressure of 281 g/cm$^2$. Then, a test silicon wafer was inserted in the workpiece holder and ground at a pressure of about 211 g/cm$^2$ for three minutes. Successive test silicon wafers were introduced into the workpiece holder and ground at a pressure of about 211 g/cm$^2$ for 3 min. The test silicon wafers were weighed before and after each cycle to determine the total removal in grams. The mass of material removed was converted to equivalent μm/min. as in glass testing.

Schiefer Test Procedure

The coated abrasive article for each example was converted into a 10.2 cm diameter disc and secured to a foam back-up pad by means of a pressure sensitive adhesive. The coated abrasive disc and back-up pad assembly was installed on a Schiefer testing machine (available from Frazier Precision Company, Gaithersburg, Md.), and the coated abrasive disc was used to abrade an annular ring (10.2 cm outside diameter (OD)×5.1 cm inside diameter (ID)) of cellulose acetate butyrate polymer from Seelye Plastics Inc., Bloomington, Minn. The load was 4.5 kg. The test period was 500 revolutions or cycles of the coated abrasive disc. The amount of cellulose acetate butyrate polymer removed and the surface finish (Ra and Rtm) of the cellulose acetate butyrate polymer were measured at the end of the test. Ra (arithmetic average of the scratch size in μm) and Rtm (mean of the maximum peak to valley height in μm) were measured with a Mahr Perthometer profilometer from Mahr Federal Inc., Providence, R.I.

Steel Ring Test Procedure

A Coburn fining machine Model 507 obtained from Gerber Coburn Optical Inc., South Windsor, Conn. used for this test was fitted with a flat aluminum lap to which the abrasive discs are attached. The coated abrasive article for each example was converted into a 10.2 cm diameter disc and secured to an aluminum flat lap by means of a pressure sensitive adhesive. Pin pressure was adjusted to 13.6 kg, sweep stroke was set to zero, spindle speed was set to about 675 rpm. ILOCUT honing oil number 5551A, obtained from Castrol Industrial, N. Aurora, Ill. was used at a drip rate of 1 drop/sec. A steel ring workpiece (1026 mild steel) with dimensions 5.28 cm OD×4.45 cm ID was clamped in place. The test was duration was one minute. The amount of 1026 steel removed and the surface finish (Ra and Rtm) of the steel ring workpiece were measured at the end of the test. Ra and Rtm were measured with the profilometer as in the Schiefer test.

JA Test Procedure

A custom built servo motor driven precision grinder having the characteristics of a centerless grinder and meant to simulate automotive camshaft and crankshaft finishing was used for this test. The coolant was 5% Cimtech 500 (obtained from Milacron Marketing Company, Cincinnati, Ohio) in tap water. The workpiece was a 1018 steel cylindrical ring (5.3 cm OD×4.4 cm ID×1.7 cm height). The abrasive test samples were cut to 22.9 cm×1.91 cm. Urethane rubber shoe inserts (90 durometer, Shore A) were mounted in the shoe (both available from Impco Machine Tools, Lansing, Mich.). Coolant flow rate was set to 200 mL/minute. The workpiece was clamped on the mandrel, then the abrasive sample clamped between the shoe assembly and the workpiece, with the abrasive side facing the workpiece. The force was adjusted to 22.7 kg, oscillation frequency was set to 600 rpm, with an amplitude of 1 mm, rotational speed of the drive shaft was set to 120 rpm. For a given test time, the shaft would rotate the first half of the test time in the forward direction and then in the reverse direction for the second half of the test time. The amount of 1018 steel removed and the surface finish (Ra and Rtm) of the steel cylindrical ring workpiece were measured at the end of each test. Ra and Rtm were measured with the above-described profilometer.

Preparation of Diamond Agglomerates

Glass/diamond agglomerates used in the following examples were prepared according to the method of U.S. Pat. No. 6,551,366, where the procedure given in Example 7 (column 22 line 59 to column 23 line 26), which is herein incorporated by reference, was used except as noted below for the 1.5 and 0.5 μm diamond agglomerates. A slurry was prepared as follows. About 17.5 g of dextrin ("STADEX 230") was dissolved in about 57.8 g of deionized water by stirring using an air mixer with a Cowles blade for 15 min. Next, about 0.5 g of an organosilicone surfactant ("Silwet L-7604") was added to the solution. Next, about 35 g of milled glass frit ("SP1086") was then added to the solution. The glass frit had been milled prior to use to a median particle size of about 2.5 μm. Next, about 35 g of 3-6 μm diamond powder (Beta Diamond Co., Yorba Linda, Calif.) was then added to the slurry. The slurry was continuously stirred using the air mixer for an additional 30 min. after all the above constituents had been added together. The slurry was spray dried with an outlet temperature of the spray dryer at about 90-95° C. The precursor agglomerate abrasive grains were collected at the spray dryer outlet. The spray dried precursor agglomerate abrasive grains were mixed with about 20 wt % of 3 μm aluminum oxide ("PWA3") based on the weight of the dried precursor agglomerate abrasive grains, heated in a furnace as described in Example 1 of U.S. Pat. No. 6,551,366, and sieved through a 90 μm mesh screen.

Diamond agglomerates having a size of 1.5 μm were made following the procedure of this Example 7 except the input diamonds were 1-2 μm metalbond diamond obtained from GE Superabrasives, Worthington, Ohio, and the furnace temperature was 750° C.

Diamond agglomerates having a size of 0.5 μm were made following the procedure of this Example 7 except that the input diamonds were 500 nanometer metalbond synthetic diamond powder obtained from Tomei Corporation of America, Englewood Cliffs, N.J., the furnace temperature was 720° C. and the precursor agglomerate abrasives grains were not mixed with any aluminum oxide grains prior to heating in the furnace.

Examples 1-4

These were made according to the General Procedure for making a coated abrasive article using the formulations given in Table 1.

TABLE 1

Formulations for coated abrasive articles (weights in g)

| | Example 1 | Example 2 | Example 3 | Example 4 |
|---|---|---|---|---|
| TMPTA | 50 | 33 | 22.5 | 29 |
| Epon 828 | 28.5 | 27.8 | 15.3 | 37 |
| Mondur MR | 21.5 | — | — | — |
| PAPI 580N | — | 22.2 | 13.6 | 33 |

TABLE 1-continued

Formulations for coated abrasive articles (weights in g)

| | Example 1 | Example 2 | Example 3 | Example 4 |
|---|---|---|---|---|
| Solsperse 32000 | 1 | 0.8 | 0.5 | 1 |
| Irgacure 819 | 1 | 0.8 | 0.5 | 1 |
| Additive 7 | 0.1 | 0.08 | 0.05 | 0.1 |
| OX 50 | 0.5 | 0.4 | | |
| Desmorapid DB | 0.2 | 0.16 | 0.1 | 0.2 |
| wollastonite | 96 | 77 | 47.8 | 98 |
| 1.5 μm diamond agglomerates | 2.5 | 2.1 | — | — |
| 0.5 μm diamond agglomerates | — | — | 2.1 | 4.4 |
| AA07 | — | — | 12.5 | 25 |

The abrasive articles were then tested according to the Strasbaugh test procedure using both glass disk and silicon wafer workpieces. The performance data is given in Tables 2-4 below. In Table 2, Examples 1-2 were using 1.5 μm diamond agglomerate abrasive examples on silicon wafers while Examples 3-4 were using 0.5 μm diamond agglomerate abrasive examples on silicon wafers. The inventive materials demonstrated a stable, high cut rate.

TABLE 2

Strasbaugh Test Results
Cut Rate (μm/min.) on silicon wafers

| Time | 1.5 μm abrasive | | 0.5 μm abrasive | |
|---|---|---|---|---|
| (min.) | Example 1 | Example 2 | Example 3 | Example 4 |
| 3 | 4.74 | 10.94 | 2.47 | 5.71 |
| 6 | 3.96 | 10.53 | 1.92 | 6.12 |
| 9 | 4.00 | 10.42 | 1.83 | 7.72 |
| 12 | 4.06 | 10.51 | 3.08 | 7.44 |
| 15 | 3.66 | 10.32 | 2.06 | 6.08 |

TABLE 3

Strasbaugh Test Results
Cut Rate (μm/min.) on glass disks

| Time | 0.5 μm abrasive | |
|---|---|---|
| (min.) | Example 3 | Example 4 |
| 5 | 0.289 | 0.985 |
| 10 | 0.286 | 0.685 |
| 15 | 0.352 | 0.516 |
| 20 | 0.300 | 0.567 |
| 25 | 0.404 | 0.559 |

Examples 5-7

A roll of 60 μm microfinishing film (268L available from 3M Company, Saint Paul, Minn.) was obtained prior to application of the size coat to use as a base material for these examples. The size resin for examples 6-8 was a solution of 45 g TMPTA, 61 g Epon 828, 54.2 g Mondur MR, 1.5 g Irgacure 651, and 0.5 g Desmorapid DB. After size resins were applied at the coating weights (size wt) given in Table 4, they were cured by a single pass under a 236 Watt/cm UV lamp at 11 m/min. (obtained from Fusion UV Systems Inc., Gaithersburg, Md.), using a D bulb followed by 2 min. in a forced air oven at 110° C. Then all samples were given a post cured in roll form for 5 h at 125° C. The examples were then tested using the Schiefer Test and Steel Ring Test and the results are summarized in Table 4 below.

TABLE 4

Schiefer and Steel Ring Test Results

| | | Steel Ring Test | | | Schiefer Test | | |
|---|---|---|---|---|---|---|---|
| | Size wt ($g/m^2$) | Cut (g) | Ra (μm) | Rtm (μm) | Cut (g) | Ra μm) | Rtm (μm) |
| Ex. 5 | 40 | 1.24 | 17 | 113 | 0.652 | 44 | 311 |
| Ex. 6 | 45 | 1.27 | 17 | 117 | 0.736 | 46 | 335 |
| Ex. 7 | 52 | 1.17 | 16 | 109 | 0.565 | 42 | 327 |

Examples 8-10

A roll of 80 μm microfinishing film (373L available from 3M Company) was obtained before application of the size coat and used as a base material for these examples. The size resin for Examples 8-10 was a solution of 20 g TMPTA, 40 g Epon 828, 40 g Mondur MR, 1 g Irgacure 819, and 0.2 g Desmorapid DB. Size coat solution was applied to the microfinishing film using a brush followed by a soft roller that distributed the solution evenly and removed excess solution. After size resins were applied at the coating weights indicated in Table 5, they were cured by a single pass under a 236 watt/cm UV lamp at 11 μm/min. (Fusion Systems, D bulb) followed by 2 min. in a forced air oven set at 110° C. Then all samples were given a post cure in the roll for 5 h in an oven set at 125° C. Performance of these examples was then assessed using the JA test and results are given in Table 5.

Examples 11-13

A roll of the microfinishing film of Example 8 was obtained for use as a base material before application of a size coat according to these examples. The size resin for examples 11-13 was a solution of 41 g Epon 828, 40 g Mondur MR, and 0.2 g Desmorapid DB. The size coat solution was applied to the microfinishing film using a brush followed by a soft roller that distributed the solution evenly and removed the excess. After size resins were applied at the coating weights indicated in Table 5, they were cured and post cured and tested as in Example 8. Results are given in Table 5.

Comparative Example A (CE-A)

Commercially available 80 μm microfinishing film (373L available from 3M Company) was used.

TABLE 5

JA Test Results

| | Size wt. ($g/m^2$) | 16 sec. Cut (g) | 16 sec. Ra (μm) | 16 sec. Rtm (μm) | 48 sec. Cut (g) | 48 sec. Ra (μm) | 48 sec. Rtm (μm) |
|---|---|---|---|---|---|---|---|
| Ex. 8 | 80 | 0.1215 | 21 | 211 | 0.2952 | 20 | 182 |
| Ex. 9 | 75 | 0.1312 | 20 | 197 | 0.2735 | 19 | 182 |
| Ex. 10 | 64 | 0.1351 | 19 | 197 | 0.2900 | 22 | 211 |
| Ex. 11 | 72 | 0.1349 | 20 | 203 | 0.2572 | 23 | 185 |
| Ex. 12 | 64 | 0.1459 | 20 | 188 | 0.2856 | 23 | 187 |
| Ex. 13 | 82 | 0.1177 | 21 | 212 | 0.2464 | 24 | 193 |
| CE A | 65 | 0.1318 | 18 | 186 | 0.2642 | 15 | 152 |

Examples 14-18

The hardness (100 g load) of various polyoxazolidones combined with resins commonly used to make abrasive articles was measured with a Tukon Hardness Tester, Model Tukon LR, from Wilson Mechanical Instruments, Bridgeport, Conn. Films of each formulation, having a thickness of 381 μm, were coated on glass microscope slides and the resulting films were UV cured with 2 passes at 10 m/min. using 236 watt/cm UV lamp (Fusion D) and/or thermally cured for 6 h in an oven set at 125° C. as shown in Table 6. Formulations and hardness results (KHN is Knoop hardness number) are also given in Table 6.

Comparative Example B and C (CE-B and CE-C)

In CE-B, a hardness test with size coat resin was prepared as per Example 14 except that the size resin of a solution of 98 parts by weight (pbw) ERL 4221 and 2 pbw CD1010, triarylsulfonium hexafluoroantimonate, was used. In CE-C, a hardness test with size coat resin was prepared as per Example 14 except that a size resin containing a solution of 70 parts TMPTA, 30 parts SR 368, and 1 part Irgacure 819 (I-819) was used.

TABLE 6

Hardness Results

| Example | Formulation | Parts by weight | UV Cure | Thermal cure | KHN |
|---|---|---|---|---|---|
| 14 | PAPI580N/Epon 828/Desmorapid DB | 40/50/0.5 | No | Yes | 27.5 |
| 15 | PAPI 27/Epon 828/Desmorapid DB | 39/50/0.5 | No | Yes | 26.3 |
| 16 | Desmodur CB75N/Epon 828/Desmorapid DB | 94/50/0.5 | No | Yes | 30.1 |
| 17 | Desmodur HL/Epon 828/Desmorapid DB | 116.5/50/0.6 | No | Yes | 28.4 |
| 18 | Desmodur IL/Epon 828/Desmorapid DB | 122.4/40/0.6 | No | Yes | 33.7 |
| CE-B | ERL4221/CD1010 | 98/2 | Yes | Yes | 19.8 |
| CE-C | TMPTA/SR368/I-819 | 70/30/1 | Yes | Yes | 22.1 |

Example 19

A resin plus mineral slurry paste was made by mixing 114 g Epalloy 8220, 87 g Mondur MR, 8 g Solsperse 24000, 2 g OX 50, and 900 g P120 brown aluminum oxide. After mixing until the mineral was fully dispersed, 0.5 g of Desmorapid DB was added and mixing continued for about two min. Then the mixture was used to fill a wheel mold having a 7.62 cm (3 inch) ID, 15.24 cm (6 inch) OD and 2.54 cm (1 inch) width. Then the mold was closed and heated for 75 min. in an oven set to 100° C. The wheel was then removed from the mold and post baked for 10 h in an oven set at 145° C.

The resulting wheel was dressed and tested on a lathe with a 3 inch (7.62 cm) spindle at 1750 rpm. The dresser was a conventional diamond tool used for this purpose. After dressing the wheel was used to deburr and deflash steel parts and to sharpen scissors and blades. It showed good cut and representative finish while exhibiting low wear and no burning on any of the workpieces.

It is apparent to those skilled in the art from the above description that various modifications can be made without departing from the scope and principles of this invention, and it should be understood that this invention is not to be unduly limited to the illustrative embodiments set forth hereinabove.

All publications and patents are herein incorporated by reference to the same extent as if each individual publication or patent was specifically and individually indicated to be incorporated by reference.

What is claimed is:

1. An abrasive article comprising a plurality of abrasive particles and a binder wherein the binder comprises a polymer formed by a reaction between a polyisocyanate and a polyoxirane, wherein the resulting binder is substantially free of urethane and urea linkages, and wherein the amount of polyisocyanate used to form the polymer is greater than about 75% of the amount of polyoxirane.

2. The abrasive article of claim 1 wherein the average isocyanate functionality of the polyisocyanate is greater than two.

3. The abrasive article of claim 1 wherein the average oxirane functionality of the polyoxirane is greater than two.

4. The abrasive article of claim 1 wherein the abrasive article comprises a backing.

5. The abrasive article of claim 1 wherein the plurality of abrasive particles are distributed on the surface of the binder.

6. The abrasive article of claim 5 wherein the abrasive article comprises a size coat.

7. The abrasive article of claim 1 wherein the binder is present in a size coat.

8. The abrasive article of claim 1 wherein the plurality of abrasive particles are distributed throughout at least a portion of the binder.

9. The abrasive article of claim 1 wherein the plurality of abrasive particles and the binder are in the form of a plurality of three-dimensional composites.

10. An abrasive article comprising a plurality of abrasive particles and a binder wherein the binder comprises a first polymer formed by a reaction between a polyisocyanate and a polyoxirane and a second polymer formed by a second polymerization reaction wherein the resulting binder is substantially free of urethane and urea linkages, and wherein the amount of polyisocyanate used to form the first polymer is greater than about 75% of the amount of polyoxirane.

11. The abrasive article of claim 10 wherein the average isocyanate functionality of the polyisocyanate is greater than two.

12. The abrasive article of claim 10 wherein the average oxirane functionality of the polyoxirane is greater than two.

13. The abrasive article of claim 10 wherein the abrasive article comprises a backing.

14. The abrasive article of claim 10 wherein the plurality of abrasive particles are distributed on the surface of the binder.

15. The abrasive article of claim 14 wherein the abrasive article comprises a size coat.

16. The abrasive article of claim 10 wherein the plurality of abrasive particles are distributed throughout at least a portion of the binder.

17. The abrasive article of claim 10 wherein the plurality of abrasive particles and the binder are in the form of a plurality of three-dimensional composites.

18. The abrasive article of claim 10 wherein the second polymer produced by the second polymerization reaction has functional groups capable of reacting with an isocyanate group or an oxirane group.

19. The abrasive article of claim 18 wherein the functional groups of the second polymer are capable of reacting with an isocyanate group or an oxirane group have at least partially reacted with isocyanate groups or oxirane groups of the polyisocyanate or the polyoxirane, respectively.

20. A method of making an abrasive article according to claim 1 comprising providing a plurality of abrasive particles; providing a binder comprising a polymer formed by a reaction product of a polyisocyanate and a polyoxirane, wherein the resulting binder is substantially free of urethane and urea linkages; and distributing the abrasive particles and the binder on a backing.

* * * * *

UNITED STATES PATENT AND TRADEMARK OFFICE

CERTIFICATE OF CORRECTION

PATENT NO. : 7,503,949 B2
APPLICATION NO. : 11/218808
DATED : March 17, 2009
INVENTOR(S) : Eric G Larson It is certified that error appears in the above-identified patent and that said Letters Patent is hereby corrected as shown below:

Column 4,
Line 17, delete "=based)" and insert --based)-- therefor.

Column 5,
Line 45, delete "g/cm" and insert --g/cm$^3$-- therefor.

Signed and Sealed this

Seventeenth Day of August, 2010

David J. Kappos

David J. Kappos
*Director of the United States Patent and Trademark Office*